United States Patent [19]

Moore et al.

[11] 4,146,675

[45] * Mar. 27, 1979

[54] FLOCK TREATMENT

[75] Inventors: Ricky L. Moore, Atlanta; Winston E. Hagborg, Columbus, both of Ga.

[73] Assignee: West Point-Pepperell, Inc., West Point, Ga.

[ * ] Notice: The portion of the term of this patent subsequent to Feb. 14, 1995, has been disclaimed.

[21] Appl. No.: 856,042

[22] Filed: Nov. 30, 1977

Related U.S. Application Data

[63] Continuation-in-part of Ser. No. 659,629, Feb. 20, 1976, Pat. No. 4,074,005.

[51] Int. Cl.[2] ..... B05D 5/08; B05D 7/02; B05D 1/18

[52] U.S. Cl. ..... 428/378; 427/212; 427/222; 427/384; 427/394

[58] Field of Search ..... 427/384, 212, 222, 394; 428/378

[56] References Cited

U.S. PATENT DOCUMENTS 4,074,005 2/1978 Moore et al. ..... 427/378

*Primary Examiner*—James R. Hoffman

*Attorney, Agent, or Firm*—Cushman, Darby & Cushman

[57] ABSTRACT

Flock is treated with a long chain aliphatic acid or a salt of such an acid to control static charges, increase flow and reduce waste. The acid or salt is applied from a solution in a non-aqueous liquid.

20 Claims, No Drawings

FLOCK TREATMENT

This is a continuation-in-part of our application Ser. No. 659,629 filed Feb. 20, 1976, now U.S. Pat. No. 4,074,005.

The present invention relates to treatment of flock to facilitate screening the flock, reduce waste, and improve the uniformity and the density of the flocked surface of the fabric produced from the flock. Briefly, the invention comprises adding a linear organic carboxylic acid containing at least 8 and preferably at least 10–14 carbon atoms, or a salt of such an acid, to a non-aqueous liquid in which the flock is dispersed, and separating and drying the flock. Preferred acids are those containing 14–18 carbon atoms.

Flock is made by cutting short lengths of fiber 0.05 to 1.5 inches long from continuous filaments of 1.5 to 40 denier per filament (dpf) of synthetic or man-made polymer. Best results are usually obtained with filaments of 3–15 dpf cut to lengths of 1–8 mm, preferably 3 dpf cut to 2 mm length. Generally longer lengths require higher deniers to provide the necessary stiffness. A particularly useful process for cutting flock is described in U.S. Pat. No. 3,916,040. In the process described in that patent, a tow is scoured to remove previously-applied finishes, and rinsed. While still in wet condition, the tow is directed to a cutter which cuts it into fibers of the desired length. Either prior to or after the cutting step, the fibers are subjected to a finishing operation in which suitable chemicals are applied.

The flock then is applied onto a substrate by screening it and passing it through an electrostatic field. Under the influence of the field, the flock is directed onto a surface in an orientation perpendicular to the backing and bonded with adhesive. See U.S. Pat. No. 3,490,938 and publications cited there.

In accordance with the present invention, the tow from which the flock is cut, but preferably the flock itself after cutting, is treated with a solution, in a non-aqueous solvent, of a linear saturated aliphatic monocarboxylic acid containing at least 8 carbon atoms, or a salt of such acid, with or without prior scouring, in an amount effective to improve the flow of the flock, as hereinafter defined.

The invention is particularly applicable to flock composed of synthetic polymers, such as flock composed of linear polyester of the type having repeating units connected by ester linkages in the polymer chain (e.g., polyethylene terephthalate and its copolymers), flock composed of polyamide (nylon) of the type having repeating units connected by amide linkages in the polymer chain (i.e., nylon 66, nylon 6, etc.) and flock composed of polyolefin (i.e. polyethylene, polypropylene, etc.). The invention also has been found useful with flock cut from man-made filaments including rayon, cellulose acetate and cellulose triacetate.

The linear saturated aliphatic monocarboxylic acid used in the present invention has at least 8 carbon atoms and may be e.g. palmitic acid, stearic acid, myristic acid and arachidic acid. Mixtures of such acids may be used. Examples of commercially available acids are Emery 132, 150 and 153. For reasons of cost, acids containing more than 20 carbon atoms are unattractive. Experiments have revealed that salts in which the acid contains 8 carbon atoms are of marginal usefulness, acids containing 10 carbon atoms give good results, but acids containing 12–14 carbon atoms or more are especially preferred. Mixtures of acids may be used. Appropriate esters of these acids which either contain or saponify to give free acid may also be used.

If a metal salt is used, almost any metal is suitable. The metal may be a divalent metal, i.e. metals of Group IIA or B (see Periodic Table of the Elements, *Handbook of Chemistry and Physics*, 44th Edition, Chemical Rubber Publishing Co., pages 448–449, Groups IIa and IIb). These include divalent metals such as zinc, calcium, or magnesium. However, other divalent metals may be used such as lead, manganese, barium, nickel, iron, and tin. Monovalent and trivalent metals such as lithium and aluminum also may be used.

The non-aqueous liquid may be any liquid which dissolves the acid or salt but does not adversely affect the flock. Since the fatty acids have long aliphatic chains, non-polar liquids are preferred, such as saturated or unsaturated hydrocarbon liquids such as heptane, kerosene, etc. While e.g., aromatic hydrocarbons may be used, their added expense is not required in most cases.

The amount of acid used is between about 0.025 to 0.4 g/liter of solvent in the treating solution at a fiber concentration of 20 g/l; preferably in the case of stearic acid the amount is 0.05 to 0.2 g/liter. If the acid is applied in the form of a salt, the concentration of the salt used is about the same as for the acid, preferably 0.2 to 1.0 gram per liter at a fiber concentration of 20 g/l. Higher concentrations of fibers make the mixture thicker and hard to stir; they also require more of the acid or salt. At lower fiber concentration, less acid or salt may be used. When a salt is used, excess salt causes no difficulty except for possible dust problems arising from dust of the excess salt coming off the fibers.

The solution containing acid or metal salt of the acid may simply be agitated with the flock, using sufficient solvent to thoroughly wet the flock. The solution may be at 50° F. or higher temperature. This procedure is believed to deposit a monomolecular film of acid or salt on the flock.

The following example illustrates the process, all parts and percentages being by weight.

EXAMPLE

To 1 liter of n-heptane there is added 0.2 grams of stearic acid and then 20 grams of Nylon 6 prescoured flock (scoured and rinsed prior to cutting). The flock is 3 denier per filament/2mm long. The liquid is stirred for 5 minutes. Then the flock is separated and allowed to dry.

Flock performance for this size flock is measured by adding 15 grams of fibers to a cylindrical container whose bottom consists of a #12 mesh U.S. Standard sieve. A rotating brush is lowered to screen level and the sample is brushed for 300 rotations of the brush. The percentage of fibers passing through the screen is determined by weighing and recorded as percent flow. Typically, flows of 80–90% are observed, and similar flows are observed for Nylon 66 flock.

What is claimed is:

1. A method for the treatment of flock which comprises suspending the flock in a non-aqueous solution of a linear, saturated aliphatic monocarboxylic acid having at least 8 carbon atoms or a metal salt of said acid, said solution containing said acid or salt in an amount sufficient to increase the flow of said flock, and separating and drying the flock.

2. A method for the treatment of flock as set forth in claim 1 wherein the metal salt is a salt of a divalent metal.

3. A method for the treatment of flock as set forth in claim 2 wherein the divalent metal is a metal of Group II of the Periodic Table of Elements.

4. A method for the treatment of flock as set forth in claim 3 wherein said metal is calcium.

5. A method for the treatment of flock as set forth in claim 1 wherein said acid contains at least 10 carbon atoms.

6. A method for the treatment of flock as set forth in claim 5 wherein said acid contains at least 12 carbon atoms.

7. A method for the treatment of flock as set forth in claim 6 wherein said acid contains 14 to 20 carbon atoms.

8. A method for the treatment of flock as set forth in claim 7 wherein said acid comprises stearic acid.

9. A method for the treatment of flock as set forth in claim 8 wherein the flock is treated with calcium stearate.

10. A method for the treatment of flock as set forth in claim 1 wherein the flock is a synthetic or man-made textile.

11. A method for the treatment of flock as set forth in claim 10 wherein the flock is selected from the group consisting of polyester, polyamide, polyolefin, rayon, cellulose acetate and cellulose triacetate.

12. A method for the treatment of flock as set forth in claim 11 wherein the flock is polyamide.

13. A method for the treatment of flock as set forth in claim 12 wherein the flock is nylon 66.

14. A method for the treatment of flock as set forth in claim 1 wherein the flock is 1.5 to 40 dpf and 0.5 to 15 mm long.

15. A method for the treatment of flock as set forth in claim 14 in which the flock is 3–15 dpf and 1–8 mm long.

16. A method for the treatment of flock as set forth in claim 15 wherein the flock is 3 dpf and 2 mm long.

17. A method for the treatment of flock as set forth in claim 1 wherein the amount of said acid is 0.025 to 0.3 g/liter of solution.

18. A method for the treatment of flock as set forth in claim 1 wherein a metal salt of said acid is used.

19. Flock which has been treated by the method of claim 1.

20. A method for the treatment of nylon 66 flock which is 3 dpf, 2 mm long, which comprises suspending 20 grams per liter of the flock in a solution of stearic acid in heptane containing at least 0.025 gram/liter of stearic acid and separating and drying the flock.

* * * * *